United States Patent [19]

Cairo

[11] Patent Number: 4,489,448

[45] Date of Patent: Dec. 25, 1984

[54] FOOT SUPPORT FOR SHOWERS

[76] Inventor: John B. Cairo, 1890 Alla Panna Way, Sandy, Utah 84092

[21] Appl. No.: 493,283

[22] Filed: May 10, 1983

[51] Int. Cl.[3] ..... A47K 3/022

[52] U.S. Cl. ..... 4/574; 4/611; 4/622; 297/439; D6/351; 248/118

[58] Field of Search ..... 4/574, 611, 622; 248/118, 176, 188.9; 297/438, 439, 459; D6/32–36, 74; 33/3 B, 3 C

[56] References Cited

U.S. PATENT DOCUMENTS

| | | | |
|---|---|---|---|
| D. 170,853 | 11/1953 | Danham | 4/574 X |
| 1,232,223 | 7/1917 | Clarke | 4/574 |
| 1,265,609 | 5/1918 | Carry | 297/439 X |
| 1,272,936 | 7/1918 | Frazzano | 4/574 |
| 2,699,310 | 1/1955 | Evans | 248/188.9 |
| 2,818,577 | 1/1958 | Kubik et al. | 4/611 |
| 3,396,413 | 8/1968 | Kaufman | 4/574 |

*Primary Examiner*—Charles E. Phillips

*Attorney, Agent, or Firm*—Mallinckrodt, Mallinckrodt, Russell & Osburn

[57] ABSTRACT

A foot support for use in a shower stall or bathtub enclosure during showering, whereon a person can rest or support his foot while applying soap thereto, the support including a series of indentation therein that confirm to a bather's foot, either left or right, wherein the foot is rested and supported as it is soaped, eliminating slippage thereof as it is pivoted and canted as it is washed.

9 Claims, 5 Drawing Figures

FOOT SUPPORT FOR SHOWERS

BACKGROUND OF THE INVENTION

1. Field

The invention is in the field of foot supporting devices for use when washing or drying the feet while or after showering.

2. State of the Art

As a general rule, must shower stalls and shower/-bath combinations do not provide adequate horizontal surface areas which can be used to support a foot while washing it. Accordingly, a person taking a shower must either balance on one foot while washing the other or bend down uncomfortably. This problem has been recognized and dealt with in the past. For example, U.S. Pat. No. 1,272,936 provides for a foot support device which can be applied to the spigot and easly removed, while U.S. Pat. No. 2,818,577 contemplates a device having an elongated body member with the foot support mounted at the upper end of the body member with a telescopically mounted T-bar at the lower end. U.S. Pat. No. 1,232,223 describes a bath-tub foot-rest formed in the shape of the sole of a boot or shoe whereby the portion of the foot-rest is connected to the upper surface of the tub.

BRIEF SUMMARY OF THE INVENTION

With the foregoing in mind, the present invention provides a supporting platform for either foot with indentations in the receiving surface thereof that correspond in general with the shape of the undersurfaces of both a right and a left foot combined into a single contoured print. This permits access to all areas of either foot to discourage slippage while providing adequate foot support to avoid the usual necessity of balancing on one foot while washing or drying the other.

The footprint indentations comprise a depression defining a heel rest, formed to hold the heel in place when weight is concentrated on the heel as the remainder of the foot is raised, the toes moving freely as they are being washed or dried. Forward of the heel indentations are toe-receiving indentations to hold the toes in place while allowing for heel movement, and a longitudinal, centrally located groove between the heel indentation and toe indentations to receive the longitudinal margins of the foot and permit raising of the opposite arched margin.

So that either foot can be supported by the same footprint, the toe indentations are applied in two, substantially contiguous, transverse rows, one of which forms the forward end of the footprint and accepts the big toe and second toe of either foot while the other row accepts the three smaller toes of either foot. Preferably, the indentations each include a drain opening at a low point in each for venting water.

For convenience, the device may be constructed as a foot-stool with its front end tapered at a 45° angle so as to fit in a right-angle corner which most shower stalls or shower baths have.

THE DRAWINGS

The best mode presently contemplated of carrying out the invention is illustrated in the accompanying drawing in which:

FIG. 1 is a perspective view of the foot support;

FIG. 2, a top plan view of the platform of the foot support;

FIG. 3, a transverse section of the foot support taken along line 3—3 of FIG. 1;

FIG. 4, a longitudinal vertical section of the foot support taken along line 4—4 of FIG. 1; and FIG. 5, a fragmentary vertical section taken on line 5—5 of FIG. 1.

DETAILED DESCRIPTION

Figure 1:
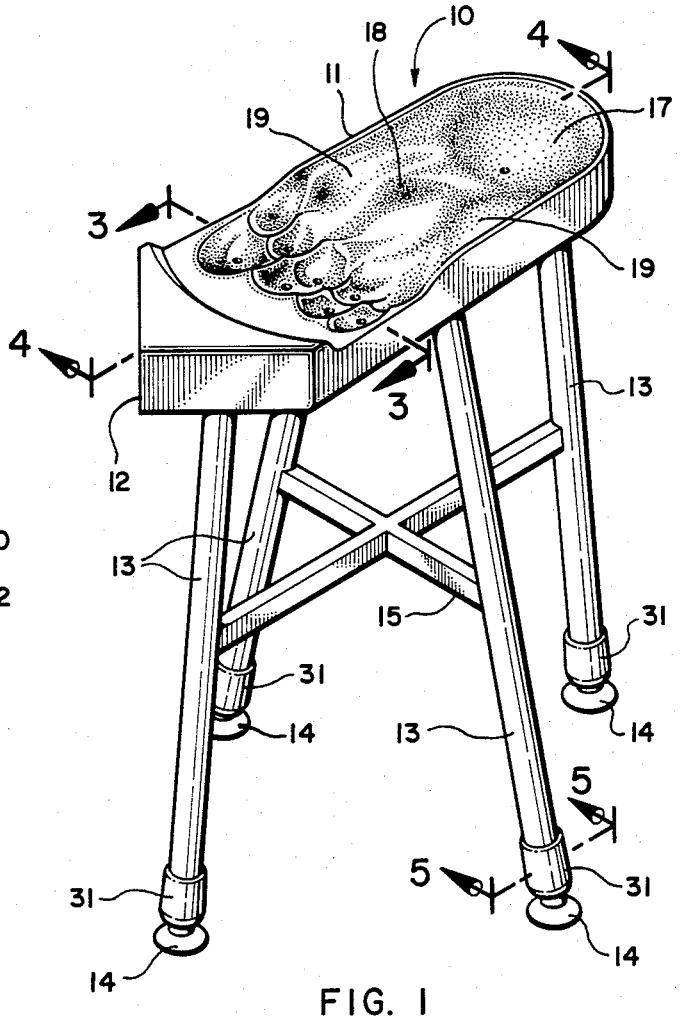
Figure 3:
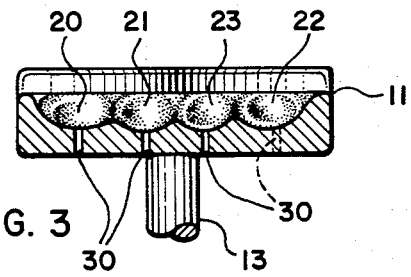

FIG. 1 shows a perspective view of a preferred embodiment of a foot support 10 for use in a conventional shower stall or tub whereon a person can support his foot as he applies soap over the foot. The support consists of a platform 11 of any convenient elongate shape and preferably includes a V-shaped prow end 12 with sides angled at approximately forty-five degree (45°) so the support will fit snugly in a right angle corner as can be found in most shower stalls. The platform is supported on legs 13 that individually connect to and extend from support points on the undersurface of platform 11. Legs 13 preferably include suction cups or other non-slip feet 14 for engaging the bottom of the shower stall or tub. A cross member 15 extends between the legs for lending lateral stability to the support.

While the arrangement of platform 11 supported on legs 13 is preferred, platform 11 could be secured directly to the shower stall or bathtub enclosure wall or walls in any suitable manner such as, for example, by screws or bolts, or by being molded in as part of a molded or cast shower stall or bathtub enclosure. Alternately, the front portion of the platform could be arranged to fit on top of a tub, thereby eliminating some of the legs. In such instance, a single leg at the back of the support might be all that would be required to maintain the foot support at a proper height and secure in the bathtub enclosure.

Foot support 10, as shown in FIGS. 1–4, provides secure support to a foot resting thereon by the inclusion of depressions or indentations formed in the upper surface or face of platform 11 that follow the contours of the prints of both left and right feet. The indentations provide support for a foot placed thereon, limiting the danger of that foot slipping off the platform. The indentations are combined into a single partially superimposed arrangement of indentations that correspond, in general, with the footprint and shape of the undersurfaces of either a person's left or right foot. Going from heel to toe, the indentations include a heel rest 17 that is appropriately rounded to accommodate the weight exerted thereon and to support heel rotation as when the person's foot is pitched upwardly or canted laterally so as to provide access to the foot sole for applying soap and water thereto. Forwardly from the heel indentation, the indentations include a longitudinal center groove 18 formed to support the foot's outer margins or sides. The sides of groove 18 slope laterally upwardly at 19, as shown best in FIG. 4, to accommodate the foot instep or arch. So arranged, a person positioning his heel in indentation 17 with the foot outer margin fitted in the longitudinal indentation 18 can roll that foot to lift the arch out of engagement with slope 19, while still maintaining contact of the heel and outer margin within the heel and longitudinal indentations.

Figure 2:
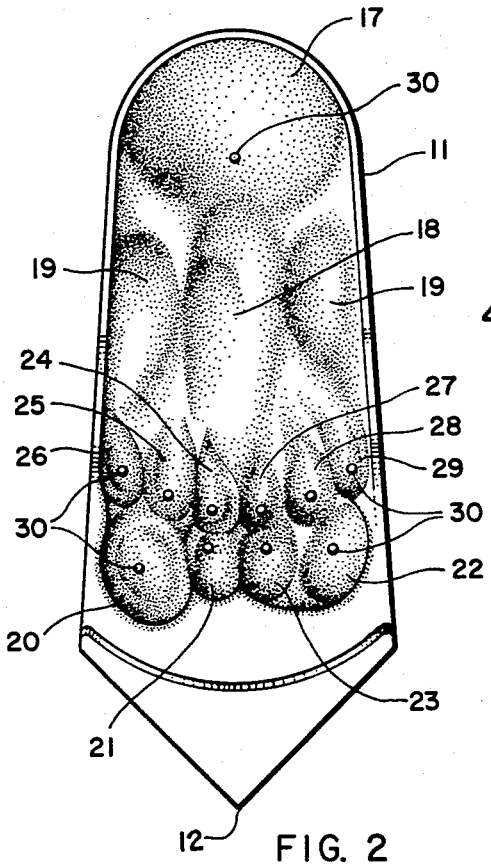

Forwardly of longitudinal groove 18, are arranged two substantially continguous, transverse rows of indentations that are preferably divided equally by a longitudinal center line through the platform, as shown best in FIG. 2. Thus, the indentations on either side of the center line are a mirror image of those on the other side. The most forward, or first row, contains four indentations 20,21,22, and 23 and forms the toe end of the print. The two outer indentations 20 and 22 are similar in size as are the two inner indentations of the first row, 21 and 23. The second row contains six indentations, 24 through 29. Here again, the two outer indentations 26 and 29 are similarly sized as are the two next indentations 25 and 28 and the two inner indentations 24 and 27.

With a left foot placed on the support and the toes in the toe-receiving indentations, the big toe would fit into indentation 20, the next toe into indentation 21, and the next three toes into indentations 27, 28, and 29, respectively. Thus, the first two toes fit into indentations in the first row of indentations while the last three toes fit into indentations of the second row. With a right foot on the support, the big toe fits into indentation 22, the second toe into indentation 23, and the last three toes into indentations 24, 25, and 26, respectively.

Figure 4:
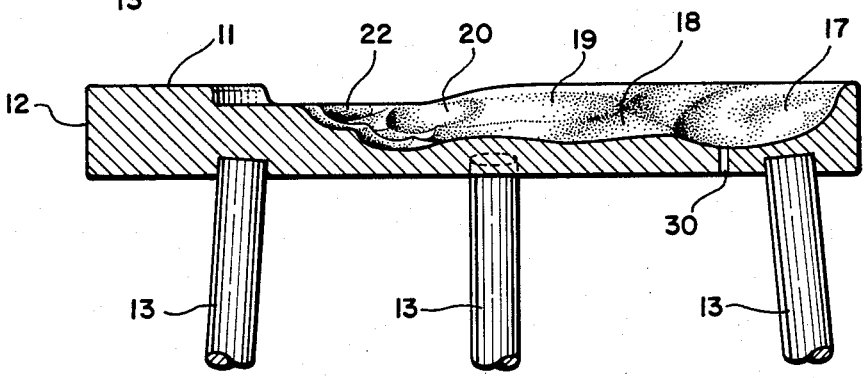

FIG. 4 shows how the toe and heel indentations slope downwardly to a lowest point in each, with the instep indentation 18 sloping both forwardly and rearwardly. So arranged, water will tend to drain to these lowest points and is preferably vented therefrom through openings 30. As shown best in FIG. 2, openings 30 are arranged, respectively, in the heel indentation 17 and all of the toe indentations 20 through 29. So arranged, the contoured print will not collect water during use, and water striking the platform will tend to rinse any soap residue out through the openings, limiting the likelihood of a person's foot slipping out of the indentations when the foot is pivoted or canted during the washing process.

While the preferred embodiment of the foot support of the present invention has been shown as including a number of defined indentations for accommodating individual toes, it should be understood that the invention is not limited to this configuration only. Such toe rests could, for example, consist of a pair of elongate indentations, not shown, that each slant oppositely and cross one another at the longitudinal center axis, the angle of the slant of each elongate indentation conforming to the slope of a person's toes. Additionally, while the arrangement of platform 11 as including an angled nose or prow 12 on one end thereof for fitting snugly in a shower tub or stall corner is preferred, it should be understood that the platform could be shaped in any appropriate configuration so long as such shape provides sufficient room thereon for accommodating the described combination left and right contoured footprint.

Figure 5:
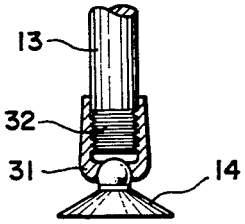

For use in a bathtub where the bottom may be sloped instead of flat, it may be desirable to provide some height adjustment to the legs such as by threaded leg end caps 31 which mate with threads 32 on the lower ends of legs 13, see FIG. 5. By rotating caps 31, the length of each leg may be independently adjusted.

With the configuration of the foot support shown, the configuration is somewhat universal in that variously sized feet will fit into and be supported by the indentations therein. However, one size will not fit all feet and it may be necessary to make several sizes of foot support to accommodate different size ranges of feet.

While the foot support of the invention is particularly useful for washing and drying feet in a shower stall or bathtub enclosure, with the support in the form of a stool, as shown, it can be moved from the stall or other enclosure if more convenient for drying the foot, and may also be used for performing other operations on a foot such as cutting or polishing toe nails.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A foot support for supporting a foot above ground level, comprising a foot supporting platform having indentations in the shape of a partially superimposed left and right human footprint, the platform indentations including an indentation at one end defining a heel rest to hold the heel in place when weight is concentrated on the heel and the remainder of the foot is raised, thereby allowing the toes to move freely, toe-receiving indentations at the end opposite said one end for holding the toes in place when weight is concentrated on the toes and the heel is raised, said toe receiving indentations including an array of indentations to receive individual toes of either foot, and a longitudinal groove located between said one end and said opposite end for supporting a longitudinal margin of the foot when weight is concentrated on such longitudinal margin; and means for supporting the platform at a height convenient for receiving a foot of a bather raised for footwashing or similar purposes.

2. A foot support according to claim 1, wherein the toe receiving indentations consist of two substantially contiguous, transverse rows of indentation, one of which forms the toe-end of the footprint and is configurated to accept the big toe and second toe of either foot, with the other configurated to accept the three smaller toes of either foot.

3. A foot support according to claim 2, wherein the toe-end forming row has four indentations and the other row has six indentations.

4. A foot support according to claim 1, wherein there are further included openings formed through the platform at low points in the heel and toe receiving indentations to allow water to drain therethrough.

5. A foot support according to claim 1, wherein the means for supporting the platform consist of a plurality of legs.

6. A foot support according to claim 5, wherein each leg includes a non-slip foot at its ground engaging end.

7. A foot support according to claim 6, wherein the non-slip feet are suction cups.

8. A foot support according to claim 5, wherein the length of each leg is individually adjustable.

9. A foot support according to claim 1, wherein the front end of the support is V-shaped to fit into a right angle corner of a shower stall or like enclosure.

* * * * *